US009316944B2

(12) United States Patent
Martin et al.

(10) Patent No.: US 9,316,944 B2
(45) Date of Patent: Apr. 19, 2016

(54) TONER CARTRIDGE HAVING AN ALIGNMENT MEMBER FOR ALIGNING WITH A DEVELOPER UNIT IN AN ELECTROPHOTOGRAPHIC IMAGE FORMING DEVICE

(71) Applicant: Lexmark International, Inc., Lexington, KY (US)

(72) Inventors: Kyle Bradley Martin, Lexington, KY (US); Randal Scott Williamson, Georgetown, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/700,704

(22) Filed: Apr. 30, 2015

(65) Prior Publication Data

US 2015/0234317 A1 Aug. 20, 2015

Related U.S. Application Data

(62) Division of application No. 14/104,054, filed on Dec. 12, 2013.

(51) Int. Cl.
*G03G 15/08* (2006.01)

(52) U.S. Cl.
CPC ..... *G03G 15/0834* (2013.01); *G03G 15/0865* (2013.01); *G03G 15/0877* (2013.01); *G03G 15/0875* (2013.01); *G03G 2215/0685* (2013.01); *G03G 2221/1654* (2013.01)

(58) Field of Classification Search
CPC ..... G03G 15/0834; G03G 15/0875; G03G 21/1842; G03G 2215/0685; G03G 2221/1654
USPC ..... 399/262; 222/DIG. 1
See application file for complete search history.

(56) References Cited

U.S. PATENT DOCUMENTS

| | | | | |
|---|---|---|---|---|
| 2005/0271425 | A1* | 12/2005 | Shimomura et al. | 399/258 |
| 2006/0171744 | A1 | 8/2006 | Ikeda et al. | |
| 2009/0142103 | A1* | 6/2009 | Chaudhuri et al. | 399/262 |
| 2010/0322676 | A1* | 12/2010 | Dawson et al. | 399/262 |
| 2013/0259532 | A1 | 10/2013 | Kubota et al. | |

FOREIGN PATENT DOCUMENTS

EP 2639648 A2 9/2013

OTHER PUBLICATIONS

European Search Report dated Apr. 24, 2015 for European Patent Application No. 14197444.4.

* cited by examiner

*Primary Examiner* — Benjamin Schmitt
(74) *Attorney, Agent, or Firm* — Justin M Tromp

(57) ABSTRACT

A toner cartridge for use with a developer unit of an image forming device includes a housing having a front, a rear, a top, a bottom, a first side and a second side. The housing has a reservoir for holding toner. An outlet port is positioned on the housing for transferring toner from the reservoir to the developer unit. An alignment slot on the front of the housing is open at a bottom end of the alignment slot to receive an alignment pin of the developer unit. The alignment slot has a width that narrows from the bottom end of the alignment slot to a middle section of the slot and that widens from the middle section of the alignment slot to a top end of the alignment slot.

9 Claims, 12 Drawing Sheets

TONER CARTRIDGE HAVING AN ALIGNMENT MEMBER FOR ALIGNING WITH A DEVELOPER UNIT IN AN ELECTROPHOTOGRAPHIC IMAGE FORMING DEVICE

CROSS REFERENCES TO RELATED APPLICATIONS

This patent application is a divisional application of U.S. patent application Ser. No. 14/104,054, filed Dec. 12, 2013, entitled "Toner Cartridge having an Alignment Member for Aligning with a Developer Unit in an Electrophotographic Image Forming Device."

BACKGROUND

1. Field of the Disclosure

The present invention relates generally to electrophotographic image forming devices and more particularly to a toner cartridge having an alignment member for aligning with a developer unit in an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll and a doctor blade are positioned in one replaceable unit (a developer unit). The image forming device's toner supply, which is consumed relatively quickly in comparison with the components housed in the developer unit, is provided in a reservoir in a separate replaceable unit in the form of a toner cartridge that mates with the developer unit. Toner flows periodically from a reservoir in the toner cartridge to the developer unit through an outlet port of the toner cartridge into an inlet port of the developer unit.

The position of the developer unit in the image forming device has some variability or play allowing the developer unit to move in order to maintain a constant force between the developer roll and a corresponding photoconductive drum for uniform printing. The variability of the position of the developer unit makes it difficult to precisely align the outlet port of the toner cartridge with the inlet port of the developer unit when the toner cartridge is installed in the image forming device. If the outlet port of the toner cartridge and the inlet port of the developer unit are not properly aligned when the two units are mated, toner leakage may occur which may result in mechanical and print quality defects. Further, if the ports are not properly aligned, an undesired force may be applied to the developer unit by the toner cartridge disturbing the positioning of the developer unit relative to the photoconductive drum which may result in non-uniform printing. Accordingly, a mechanism that provides proper alignment between the outlet port of the toner cartridge and the inlet port of the developer unit is desired.

SUMMARY

A toner cartridge for use with a developer unit of an image forming device according to one example embodiment includes a housing having a front, a rear, a top, a bottom, a first side and a second side. The housing has a reservoir for holding toner. An outlet port is positioned on the housing for transferring toner from the reservoir to the developer unit. An alignment slot on the front of the housing is open at a bottom end of the alignment slot to receive an alignment pin of the developer unit. The alignment slot has a width that narrows from the bottom end of the alignment slot to a middle section of the slot and that widens from the middle section of the alignment slot to a top end of the alignment slot. In some embodiments, the toner cartridge includes a first guide proximate the first side and a second guide proximate the second side. The first and second guides each run along a portion of the front of the housing between the top and the bottom. The first and second guides are aligned with each other in a vertical direction between the top and the bottom and spaced from each other in a horizontal direction between the first side and the second side forming the alignment slot therebetween. In some embodiments, the first guide bows toward the second side and then back toward the first side as the first guide travels up the front of the housing and the second guide bows toward the first side and then back toward the second side as the second guide travels up the front of the housing.

A toner cartridge for use with a developer unit of an image forming device according to another example embodiment includes a housing having a front, a rear, a top, a bottom, a first side and a second side. The housing has a reservoir for holding toner. An outlet port on the front of the housing proximate the first side is positioned to transfer toner from the reservoir to the developer unit. A drive gear on the front of the housing has a center closer to the second side than the outlet port. The drive gear is positioned to receive rotational power when the toner cartridge is installed in the image forming device. An alignment slot extends along a portion of the front of the housing between the top and the bottom and is positioned between the outlet port and the drive gear in a horizontal direction between the first side and the second side and positioned above the outlet port and below the center of the drive gear in a vertical direction between the top and the bottom. The alignment slot is open at a bottom end of the alignment slot to receive an alignment pin of the developer unit. The alignment slot is configured to control the position of the alignment pin of the developer unit to align the developer unit with the toner cartridge as the toner cartridge is installed in the image forming device.

BRIEF DESCRIPTION OF THE DRAWINGS

The accompanying drawings incorporated in and forming a part of the specification, illustrate several aspects of the present disclosure, and together with the description serve to explain the principles of the present disclosure.

FIGS. 9A-13A are sequential perspective views and FIGS. 9B-13B are sequential front cross-sectional views illustrating the insertion of the toner cartridge into the image forming device and the mating of the toner cartridge with the developer unit.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
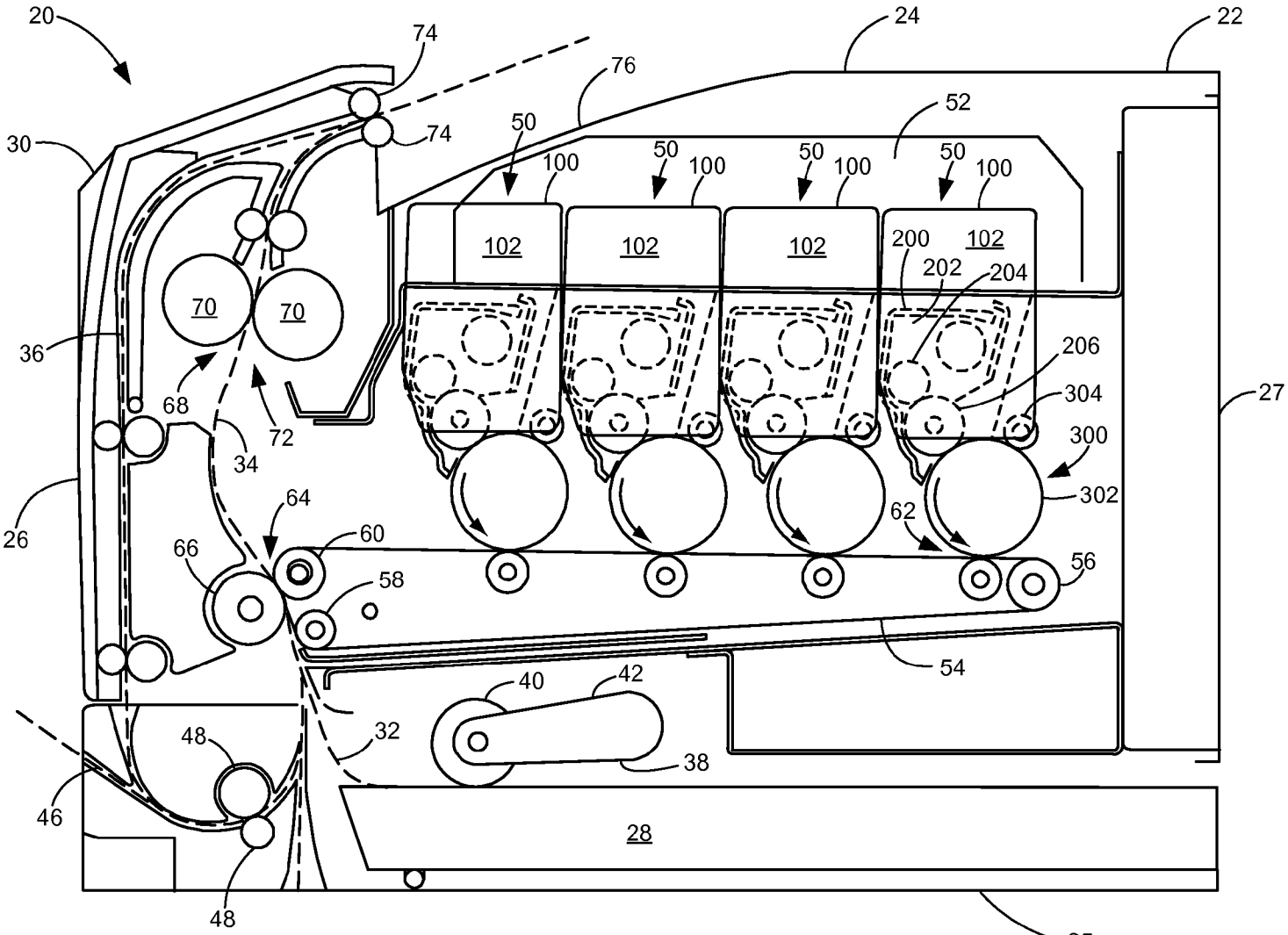
FIG. 1 is a schematic side view of the interior of an image forming device according to one example embodiment.

FIG. 1 illustrates a schematic view of the interior of an example image forming device 20. Image forming device 20 includes a housing 22 having a top 24, bottom 25, front 26 and rear 27. Housing 22 includes one or more input trays 28 positioned therein. Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel 30 may be located on housing 22. Using control panel 30, the user is able to enter commands and generally control the operation of the image forming device 20. For example, the user may enter commands to switch modes (e.g., color mode, monochrome mode), view the number of pages printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rollers. Media sheets may also be introduced into media path 32 by a manual feed 46 having one or more rolls 48.

Image forming device 20 includes an image transfer section that includes one or more imaging stations 50. Each imaging station 50 includes a cartridge 100 and a developer unit 200 mounted on a common photoconductive unit 300. Each toner cartridge 100 includes a reservoir 102 for holding toner and an outlet port in communication with an inlet port of a corresponding developer unit 200 for transferring toner from reservoir 102 to developer unit 200 as discussed in greater detail below. One or more agitating members may be positioned within reservoir 102 to aid in moving the toner. Each developer unit 200 includes a toner reservoir 202 and a toner adder roll 204 that moves toner from reservoir 202 to a developer roll 206. The photoconductive unit 300 includes a charging roll 304 and a photoconductive (PC) drum 302 for each imaging station 50. PC drums 302 are mounted substantially parallel to each other. For purposes of clarity, developer unit 200, PC drum 302 and charging roll 304 are labeled on only one of the imaging stations 50. In the example embodiment illustrated, each imaging station 50 is substantially the same except for the color of toner.

Each charging roll 304 forms a nip with the corresponding PC drum 302. During a print operation, charging roll 304 charges the surface of PC drum 302 to a specified voltage such as, for example, −1000 volts. A laser beam from a printhead 52 associated with each imaging station 50 is then directed to the surface of PC drum 302 and selectively discharges those areas it contacts to form a latent image. In one embodiment, areas on PC drum 302 illuminated by the laser beam are discharged to approximately −300 volts. Developer roll 206, which forms a nip with the corresponding PC drum 302, then transfers toner to PC drum 302 to form a toner image. A metering device such as a doctor blade assembly can be used to meter toner onto developer roll 206 and apply a desired charge on the toner prior to its transfer to PC drum 302. The toner is attracted to the areas of PC drum 302 surface discharged by the laser beam from the printhead 52.

An intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 302 apply toner images in their respective colors to ITM 54 at a first transfer nip 62. In one embodiment, a positive voltage field attracts the toner image from PC drums 302 to the surface of the moving ITM 54. ITM 54 rotates and collects the one or more toner images from imaging stations 50 and then conveys the toner images to a media sheet at a second transfer nip 64 formed between a transfer roll 66 and ITM 54, which is supported by back-up roll 60. In an alternative embodiment, instead of using an ITM 54 to transfer toner from PC drums 302 to a media sheet, toner is transferred directly from each PC drum 302 to the media sheet as is known in the art.

A media sheet advancing through simplex path 34 receives the toner image from ITM 54 as it moves through the second transfer nip 64. The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, the exit rolls 74 move the media sheet from simplex path 34 to an output area 76 on top 24 of image forming device 20. In a reverse direction, exit rolls 74 move the media sheet into duplex path 36 for image formation on a second side of the media sheet.

Figure 2:
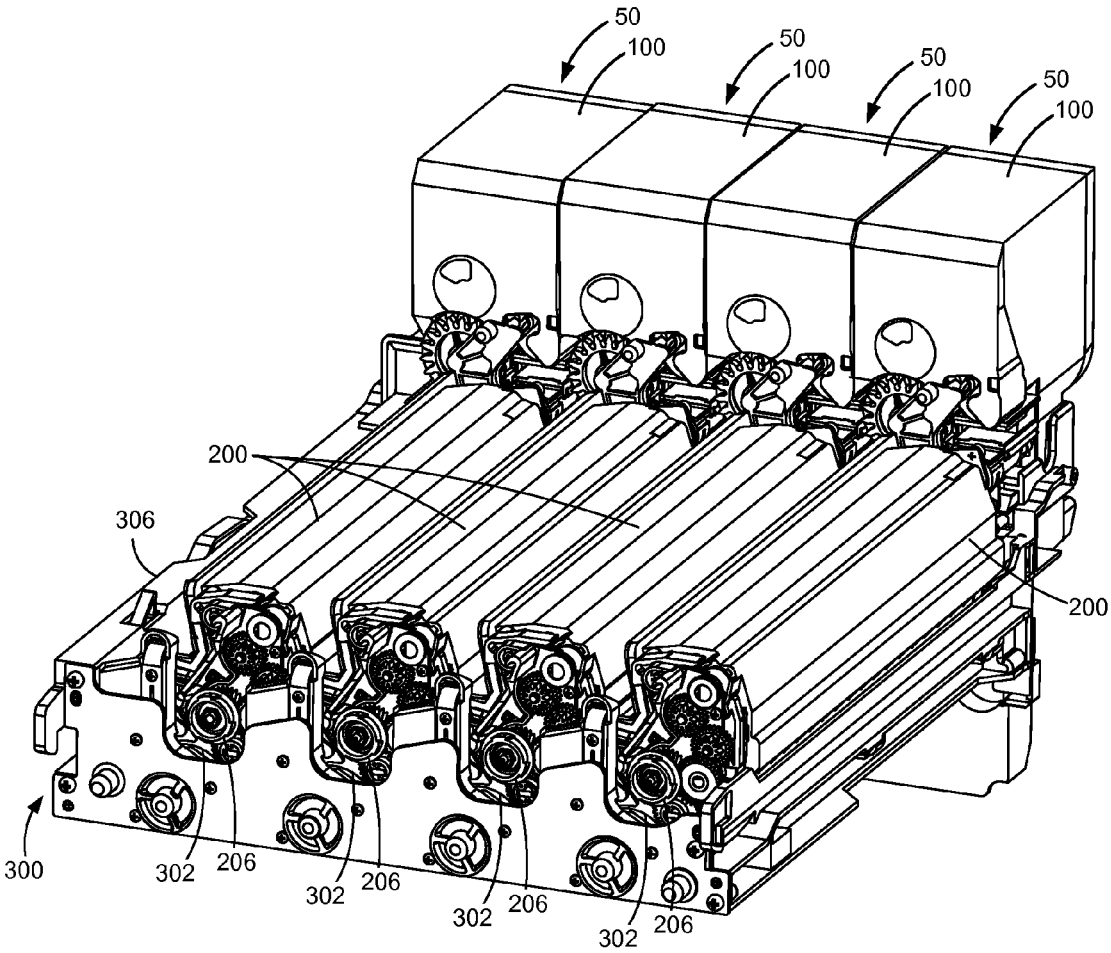
FIG. 2 is a perspective view of four imaging stations each having a toner cartridge and a developer unit for use with the image forming device according to one example embodiment.

A monocolor image forming device 20 may include a single imaging station 50, as compared to a color image forming device 20 that may include multiple imaging stations 50. FIG. 2 illustrates a set of four imaging stations 50 that each includes a respective toner cartridge 100, developer unit 200, and PC drum 302 mounted in a frame 306 of PC unit 300. In one embodiment, frame 306 is manufactured out of stamped metal plates that result in precise control of the location of PC drums 302 relative to one another and relative to ITM belt 54, printhead 52, and drive modules within image forming device 20. Frame 306 includes a central opening sized to receive developer units 200 and to mate developer rolls 206 with their respective PC drums 302.

Figure 3:
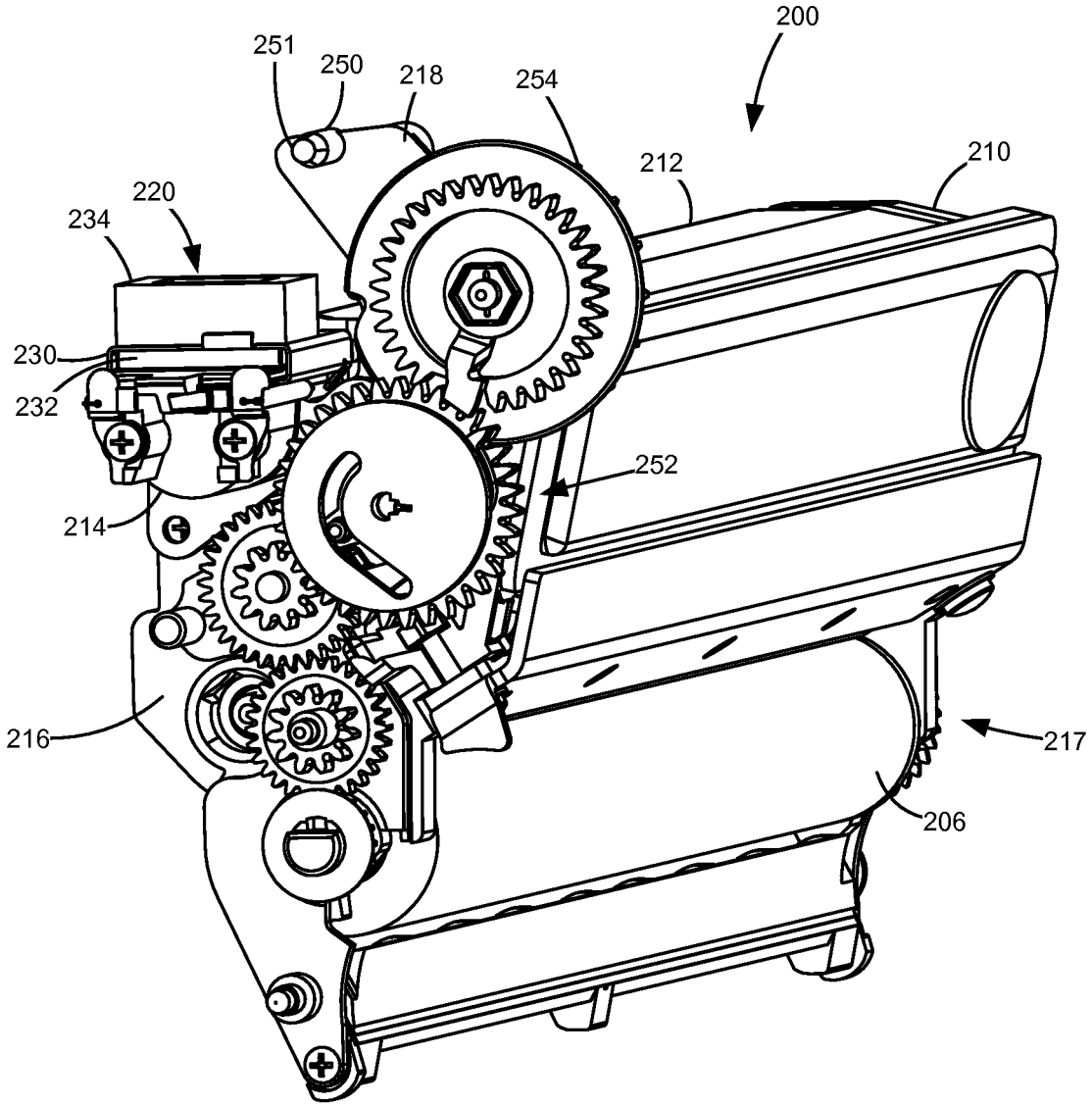
FIG. 3 is a perspective view of a developer unit according to one example embodiment.
Figure 4:
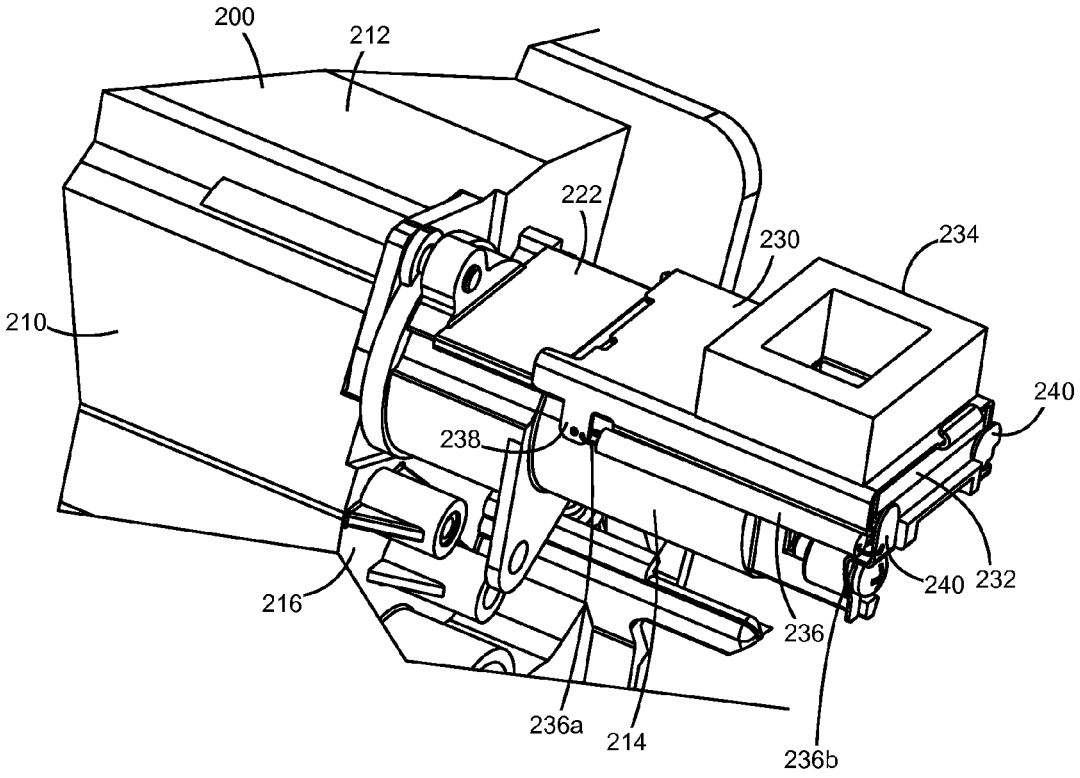
FIG. 4 is a perspective view of a portion of the developer unit shown in FIG. 3 illustrating an inlet port having a shutter in a closed position.
Figure 5:
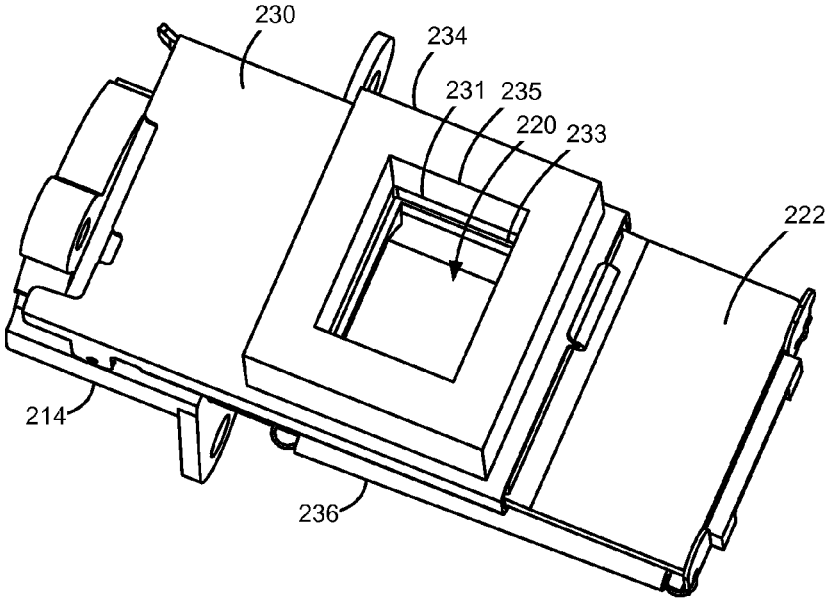
FIG. 5 is a top perspective view of a portion of the developer unit shown in FIG. 3 illustrating the shutter in an open position.

FIGS. 3-5 show developer unit 200 in greater detail according to one example embodiment. Developer unit 200 is removably mounted in frame 306 of image forming device 20. Reservoir 202, toner adder roll 204 and developer roll 206 discussed above are positioned within a housing 210 of developer unit 200. With reference to FIG. 3, housing 210 includes a main housing 212 that includes toner reservoir 202, toner adder roll 204 and developer roll 206. Housing 210 also includes an inlet extension 214 that extends from a rear 216 of main housing 212. In one embodiment, inlet extension 214 is attached to main housing 212 by fasteners such as screws (not shown). Alternatively, inlet extension 214 may be ultrasonically or vibratorilly welded to main housing 212 or formed integrally with main housing 212. Inlet extension 214 includes an inlet port 220 that permits toner to enter developer unit 200 from cartridge 100. A rotatable auger (not shown) protrudes from reservoir 202 in main housing 212 into inlet extension 214 in order to move toner from inlet extension 214 to reservoir 202 in main housing 212. Housing 210 is aligned relative to frame 306 and movable within frame 306 in order to maintain a constant force between developer roll 206 and PC drum 302 for uniform printing.

With reference to FIGS. 4 and 5, in one embodiment, a shutter 230 is positioned on a top surface 222 of inlet housing portion 214 and is slidably movable between a closed position (FIG. 4) and an open position (FIG. 5). In the open position, shutter 230 permits toner to flow from cartridge 100 into developer unit 200 through inlet port 220. In the closed position, shutter 230 blocks inlet port 220 preventing toner from entering or escaping developer unit 200. In the example embodiment illustrated, a lower seal member 232 is attached to the bottom surface of shutter 230 and seals the interface between shutter 230 and inlet extension 214. An upper seal member 234 is attached to the top surface of shutter 230 and seals the interface between shutter 230 and cartridge 100 when cartridge 100 is installed. Lower seal member 232 and upper seal member 234 are movable with shutter 230. As shutter 230 slides between the closed position and the open position, lower seal member 232 slides against top surface 222 of inlet extension 214. In one embodiment, lower seal member 232 and upper seal member 234 are formed from an elastomeric foam material such as PORON® available from Rogers Corporation, Rogers, Conn., USA. However, lower seal member 232 and upper seal member 234 may be composed of any suitable material that provides an effective toner seal as long as shutter 230 is free to slide relative to inlet extension 214.

FIG. 5 shows a top perspective view of shutter 230 in the open position. Shutter 230, lower seal member 232 and upper seal member 234 include openings 231, 233, 235, respectively, that are sized and shaped similar to inlet port 220. As shutter 230 opens, shutter 230 slides to the left as viewed in FIG. 5 until openings 231, 233, 235 are positioned over inlet port 220 to permit toner to flow from toner cartridge 100 into inlet extension 214 so that the toner can then be drawn into main housing 212.

With reference back to FIG. 4, in the example embodiment illustrated, extension springs 236 are positioned on opposite sides of shutter 230 and bias shutter 230 toward the closed position shown in FIG. 4. Springs 236 are connected at one end 236*a* to legs 238 that extend from shutter 230. The other ends 236*b* of springs 236 are connected to anchors 240 on inlet extension 214. Springs 236 bias shutter 230 against anchors 240. In addition to providing an attachment point for springs 236, anchors 240 serve as stops to limit the sliding motion of shutter 230 as it returns to the closed position.

With reference back to FIG. 3, housing 210 includes an alignment extension 218 extending upward from main housing 212 at rear 216 of housing 210. Alignment extension 218 includes an alignment pin 250 that engages with an alignment member of toner cartridge 100 as toner cartridge 100 is installed in image forming device 20 in order to align developer unit 200 relative to toner cartridge 100 as discussed in greater detail below. Rear 216 of housing 210 also includes a drive transmission 252 having a drive gear 254 that provides rotational power to toner cartridge 100 when toner cartridge 100 is installed in image forming device 20 and mated with developer unit 200. Drive transmission 252 of developer unit 200 receives rotational power at a front 217 of housing 210 from a corresponding drive gear in image forming device 20.

Figure 6:
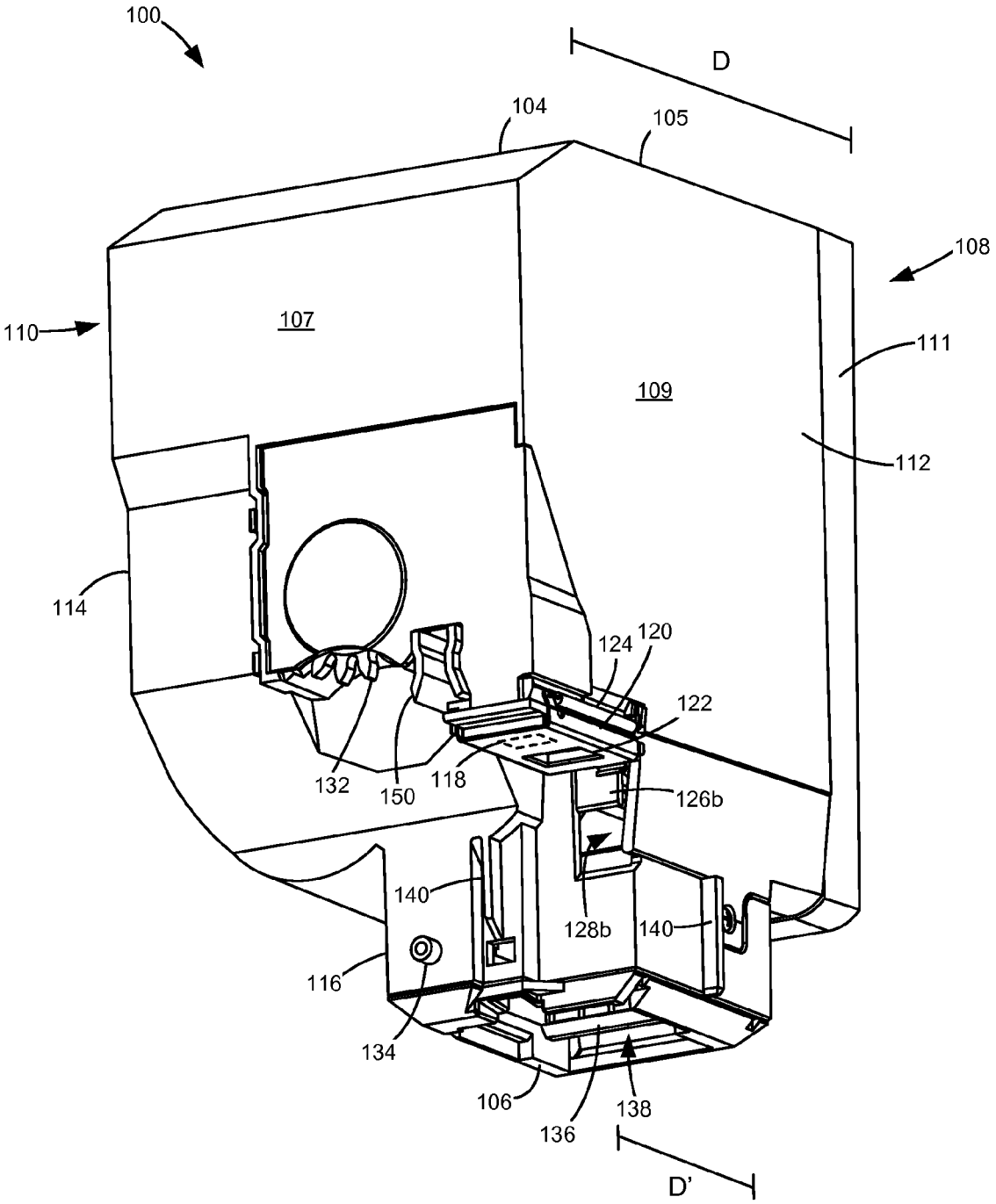
FIG. 6 is a front perspective view of a toner cartridge according to one example embodiment.
Figure 7:
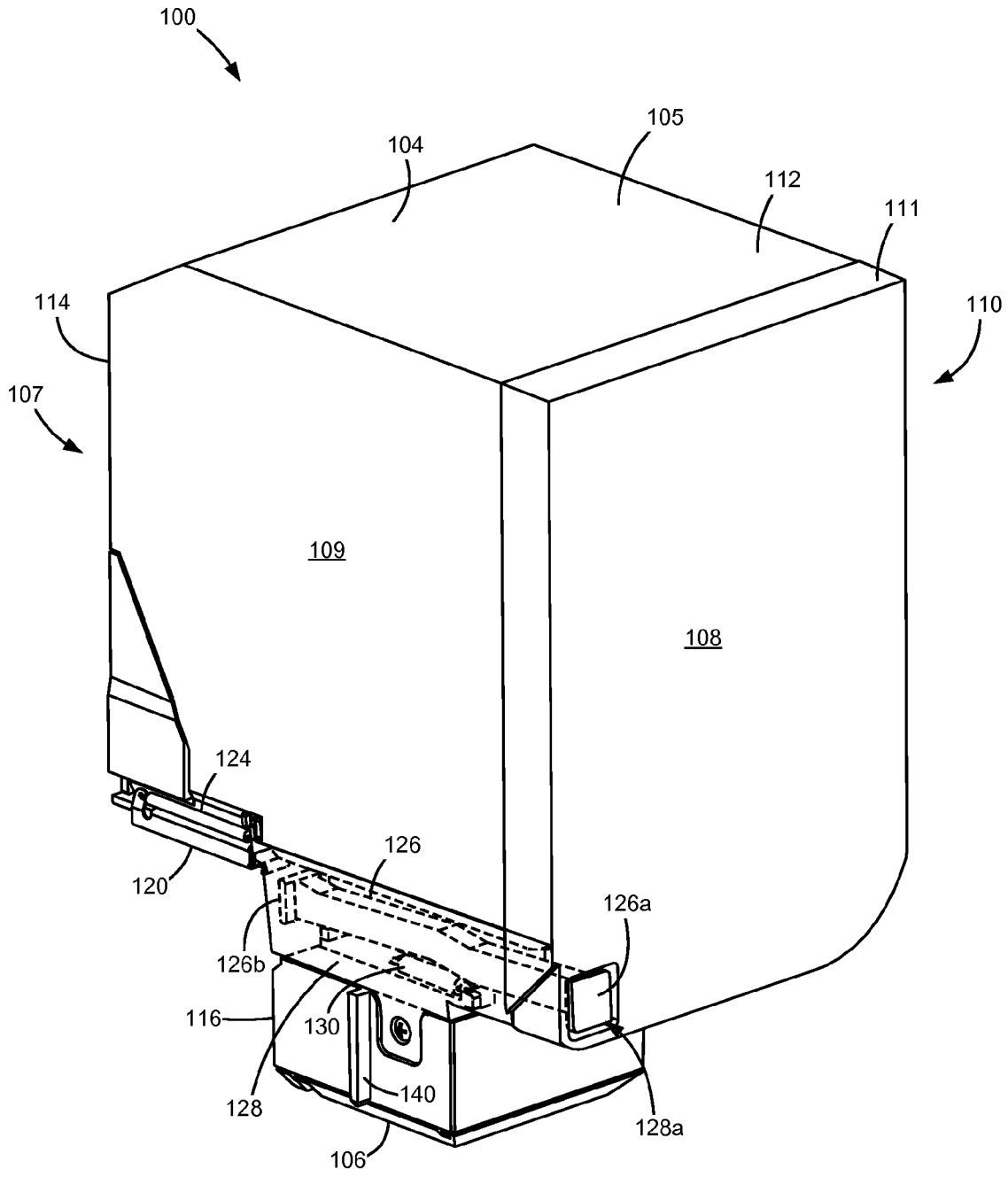
FIG. 7 is a rear perspective view of the toner cartridge shown in FIG. 6.
Figure 8:
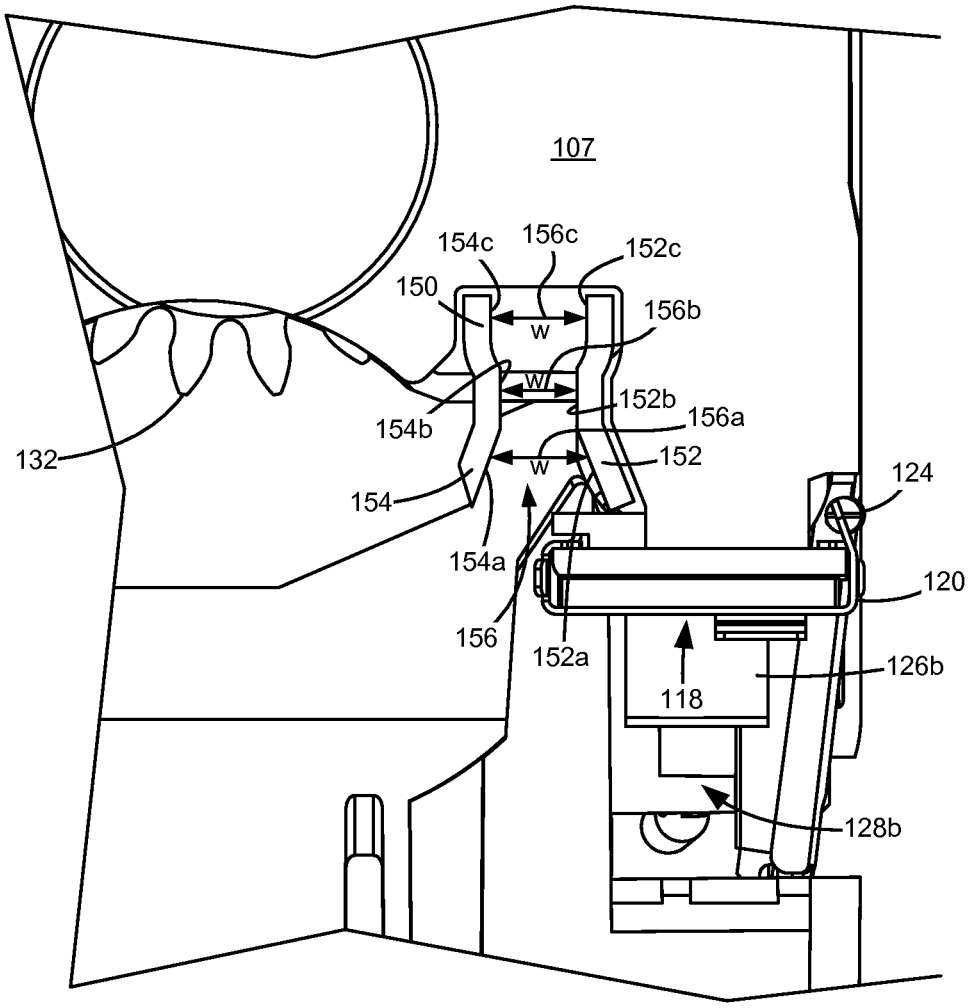
FIG. 8 is a front elevation view of a portion of the toner cartridge shown in FIG. 6 illustrating an alignment member.

FIGS. 6-8 show a toner cartridge 100 in greater detail according to one example embodiment. Toner cartridge 100 includes a housing 104 having a top 105, a bottom 106, a front 107, a rear 108 and a pair of sides 109, 110 and forming reservoir 102 therein. In one embodiment, housing 104 is comprised of an end cap 111 mounted on, such as by ultrasonic welding, a main housing 112 at the rear 108 of cartridge 100. Housing 104 includes a main section 114 and an extension section 116. Extension section 116 is positioned at the bottom 106 of housing 104. As illustrated in FIG. 6, a depth D' of extension section 116 measured between the front 107 and rear 108 is smaller than a depth D of main section 114. Toner cartridge 100 includes an overall height measured between top 105 and bottom 106. In one embodiment, extension section 116 includes a smaller height than main section 114.

Toner cartridge 100 includes an outlet port 118 for transferring toner to developer unit 200 through inlet port 220 of developer unit 200 (FIGS. 3 and 5). Outlet port 118 is formed as a downward facing opening on main section 114 on the front 107 of housing 104 near side 109. In one embodiment, a shutter 120 is positioned on a bottom portion of main section 114 of housing 104 and is slidably movable between an open position and a closed position. In the open position, shutter 120 permits toner to flow from outlet port 118 of cartridge 100 through an opening 122 in shutter 120. In the closed position, shutter 120 blocks outlet port 118 to prevent toner from escaping cartridge 100. Shutter 120 is biased toward the closed position blocking outlet port 118. For example, one or more extension springs 124 may bias shutter 120 toward the closed position as shown.

In the example embodiment shown, toner cartridge 100 also includes an engagement member such as a plunger 126 that is positioned to open shutter 120 of toner cartridge 100 and shutter 230 of developer unit 200 when toner cartridge 100 is installed and mated with developer unit 200 and an access door to image forming device 20 is closed. Plunger 126 extends through a channel 128 in housing 104. Channel 128 extends from rear 108 of housing 104 to front 107 of housing 104 below outlet port 118. Channel 128 includes a rear opening 128*a* and a front opening 128*b*. With reference to FIG. 7, a rear end 126*a* of plunger 126 is exposed at rear opening 128*a* of channel 128 to receive an actuation force from an actuation member, such as a plunger, rib, projection, arm, etc., operatively coupled to an access door of image forming device 20 when the access door is closed. With reference to FIG. 6, a front end 126*b* of plunger 126 is exposed at front opening 128*b* of channel 128 to allow plunger 126 to contact shutters 120 and 230 and push shutters 120 and 230 from their closed positions to their open positions when plunger 126 receives the actuation force. Plunger 126 is biased by one or more biasing members, such as an extension spring 130 (FIG. 7), toward rear 108 of housing 104 with rear end 126*a* of plunger 126 exposed to receive the actuation member of image forming device 20. In the example embodiment illustrated, spring 130 is connected at one end to plunger 126 and at the other end to a portion of housing 104 within channel 128.

Toner cartridge 100 further includes a drive gear 132 positioned on the front 107 of housing 104. Drive gear 132 meshes with and receives rotational power from drive gear 254 of developer unit 200 in order to provide rotational power to various paddles and/or agitators and an auger positioned within reservoir 102 for moving toner within reservoir 102 to outlet port 118. In the example embodiment illustrated, drive gear 132 is partially covered with only a few teeth exposed on a bottom portion thereof. Drive gear 132 is positioned on main section 114 of housing 104 above outlet port 118 closer to side 110 than outlet port 118.

Where multiple toner cartridges 100 are used with a single image forming device 20, toner cartridge 100 may include a keying structure 134 that prevents a toner cartridge 100 from being inserted in the wrong location. For example, where each toner cartridge 100 in image forming device 20 provides a different color toner, such as where toner cartridges having black, cyan, yellow and magenta toners are used, keying structure 134 prevents each toner cartridge 100 from being inserted into the location corresponding with any other color. For example, keying structure 134 may prevent a toner cartridge 100 containing cyan colored toner from being positioned in the location for a black, yellow or magenta toner cartridge. In the example embodiment illustrated, keying structure 134 is positioned on the front 107 of extension section 116 of housing 104 near side 110.

Toner cartridge 100 may include an electrical connector 136 having processing circuitry for communicating with a controller of image forming device 20. The processing circuitry may provide authentication functions, safety and operational interlocks, operating parameters and usage information related to toner cartridge 100. In the example embodiment illustrated, electrical connector 136 is positioned in a cavity 138 formed in the bottom 106 of housing 104. When toner cartridge 100 is installed in image forming device 20, contacts on electrical connector 136 mate with corresponding electrical contacts of image forming device 20 to establish a communications link to the controller of image forming device 20.

Toner cartridge 100 may also include various positioning members 140 that position toner cartridge 100 relative to developer unit 200 and frame 306 of PC unit 300 during insertion of toner cartridge 100 into image forming device 20. For example, positioning members 140 may include a combination of projections that project outwardly from front 107, rear 108 and/or sides 109, 110 of housing 104 and/or elongated slots formed as depressions in front 107, rear 108 and/or sides 109, 110 that mate with corresponding slots and/or projections, respectively, to ensure accurate positioning of toner cartridge 100. For example, positioning members 140 help ensure that outlet port 118 mates with inlet port 220 of developer unit 200, that drive gear 132 mates with drive gear 254, and that electrical connector 136 mates with corresponding electrical contacts.

With reference to FIGS. 6 and 8, toner cartridge 100 also includes an alignment member 150 on front 107. In one embodiment, alignment member 150 is positioned on main section 114 between drive gear 132 and outlet port 118 in a horizontal direction between side 109 and side 110. In this embodiment, alignment member 150 is positioned in a fixed position above outlet port 118 and below a centerline of drive gear 132. Alignment member 150 includes a pair of generally vertically extending guides 152, 154 having a generally vertical slot 156 between them. Guides 152, 154 are aligned with each other in a vertical direction of toner cartridge 100 between top 105 and bottom 106 and are spaced from each other in the horizontal direction of toner cartridge 100 between side 109 and side 110 forming slot 156 therebetween. Slot 156 is open at its bottom end to receive actuation pin 250 as discussed in greater detail below.

Each guide 152, 154 includes a first ramped surface 152*a*, 154*a* at a bottom portion thereof. The width W of a lead-in section 156*a* of slot 156 formed between first ramped surface 152*a* and first ramped surface 154*a* narrows as first ramped surfaces 152*a*, 154*a* travel up front 107 of housing 104. In this embodiment, first ramped surface 152*a* gradually projects further toward side 110 as first ramped surface 152*a* travels up front 107 and first ramped surface 154*a* gradually projects further toward side 109 as first ramped surface 154*a* travels up front 107. Each first ramped surface 152*a*, 154*a* ends at a respective peak 152*b*, 154*b* and then leads into a second ramped surface 152*c*, 154*c* as guides 152, 154 travel up front 107. The width W of slot 156 is narrowest at an alignment section 156*b* of slot 156 formed between peak 152*b* and peak 154*b* in the middle of slot 156. The width W of a lead-out section 156*c* of slot 156 widens as second ramped surfaces 152*c*, 154*c* travel up front 107. In this embodiment, second ramped surface 152*c* gradually projects further toward side 109 as second ramped surface 152*c* travels up front 107 and second ramped surface 154*c* gradually projects further toward side 110 as second ramped surface 154*c* travels up front 107. In other words, guide 152 gradually bows toward side 110 and then back toward side 109 as guide 152 travels up front 107 and guide 154 gradually bows toward side 109 and then back toward side 110 as guide 154 travels up front 107. Accordingly, in the example embodiment illustrated, first ramped surfaces 152*a* and 154*a* taper toward each other as guides 152 and 154 travel up front 107 and second ramped surfaces 152*c* and 154*c* taper away from each other as guides 152 and 154 travel up front 107. First ramped surfaces 152*a*, 154*a* are positioned below peaks 152*b*, 154*b* and peaks 152*b*, 154*b* are positioned below second ramped surfaces 152*c*, 154*c*. Alignment member 150 may be referred to as having an hour-glass shape because of the profile of guides 152 and 154. In the example embodiment illustrated, peaks 152*b*, 154*b* of guides 152, 154 include a surface that extends substantially vertically, substantially parallel to sides 109, 110.

In the example embodiment illustrated, guide 152 and guide 154 include multi-faceted surfaces 152*a*, 152*b*, 152*c* and 154*a*, 154*b*, 154*c*. However, the surfaces of guides 152 and 154 may be formed using any suitable geometry. For example, in another embodiment, guide 152 and guide 154 each includes a curved surface that includes a first ramped surface 152*a*, 154*a*, a peak 152*b*, 154*b* and a second ramped surface 152*c*, 154*c*. In the example embodiment illustrated, the surfaces 152*a*, 152*b*, 152*c* and 154*a*, 154*b*, 154*c* of each guide 152 and 154 are continuous; however, in another embodiment, the surfaces of each guide 152 and 154 are formed as separate segments.

Figure 9A:
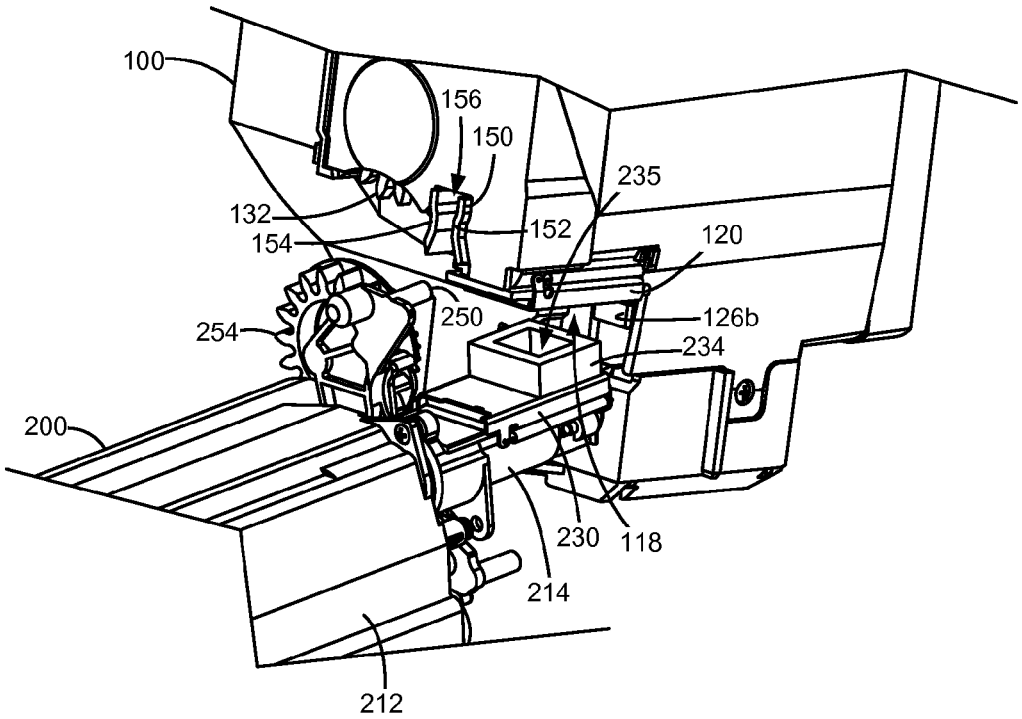
Figure 9B:
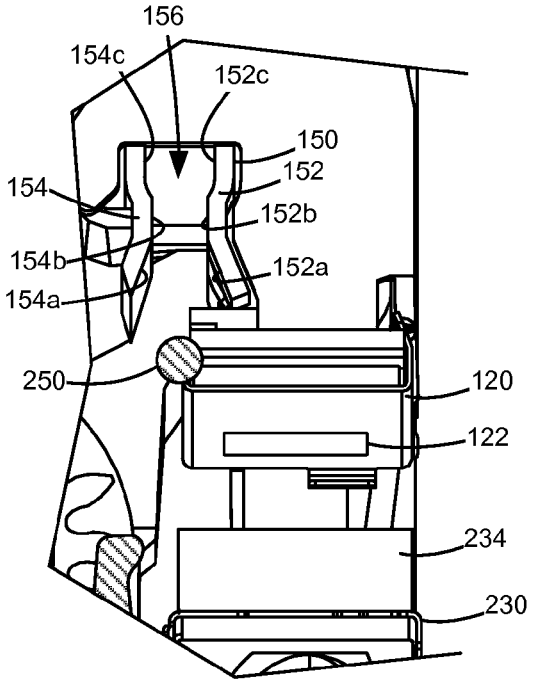

FIGS. 9A-13A and 9B-13B are sequential perspective views illustrating the insertion of toner cartridge 100 into image forming device 20 and the mating of toner cartridge 100 with developer unit 200 with PC unit 300 removed for clarity. In FIGS. 9A and 9B, toner cartridge 100 is shown advancing in a generally downward direction toward developer unit 200 which is installed in its final position in frame 306 (FIG. 2). As shown in FIGS. 9A and 9B, actuation pin 250 is spaced below alignment member 150, drive gear 254 is spaced below drive gear 132 of toner cartridge 100 and inlet port 220 and upper seal member 234 are spaced below shutter 120 and outlet port 118.

Figure 10A:
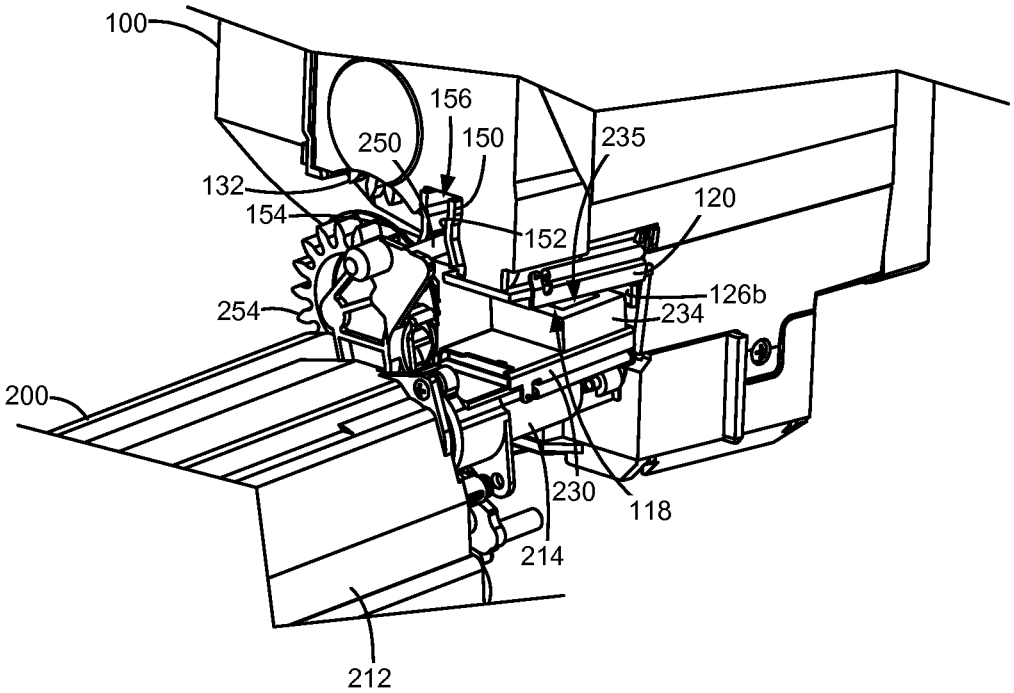
Figure 10B:
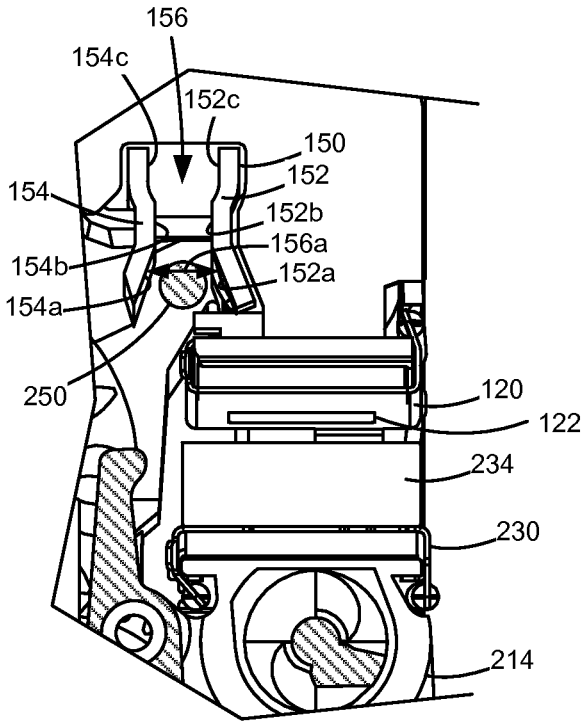

FIGS. 10A and 10B show toner cartridge 100 advanced further toward developer unit 200 with actuation pin 250 positioned in lead-in section 156*a* of slot 156 of alignment member 150 between first ramped surfaces 152*a* and 154*a*. In FIGS. 10A and 10B, drive gear 132 is advanced closer to drive gear 254 and shutter 120 is advanced closer to upper seal member 234. Lead-in section 156*a* is wide enough to capture actuation pin 250 through the entire range of motion of developer unit 200 in frame 306. In other words, the width W at the bottom end of lead-in section 156*a* of slot 156 is large enough for lead-in section 156*a* to receive actuation pin 250 at the worst case resting positions of developer unit 200 in the side-to-side direction. As toner cartridge 100 advances further, first ramped surfaces 152*a*, 154*a* direct actuation pin 250 toward the center of alignment member 150 aligning opening 122 of shutter 120 with opening 235 of upper seal member 234 in the side-to-side direction as shutter 120 nears upper seal member 234. In one embodiment, a tip 251 of actuation pin 250 is tapered in order to facilitate the entry of actuation pin 250 into lead-in section 156*a* of alignment member 150. A tapered tip 251 is particularly useful where toner cartridge 100 pivots forward and downward onto developer unit 200 instead of simply lowering vertically onto developer unit 200.

Figure 11A:
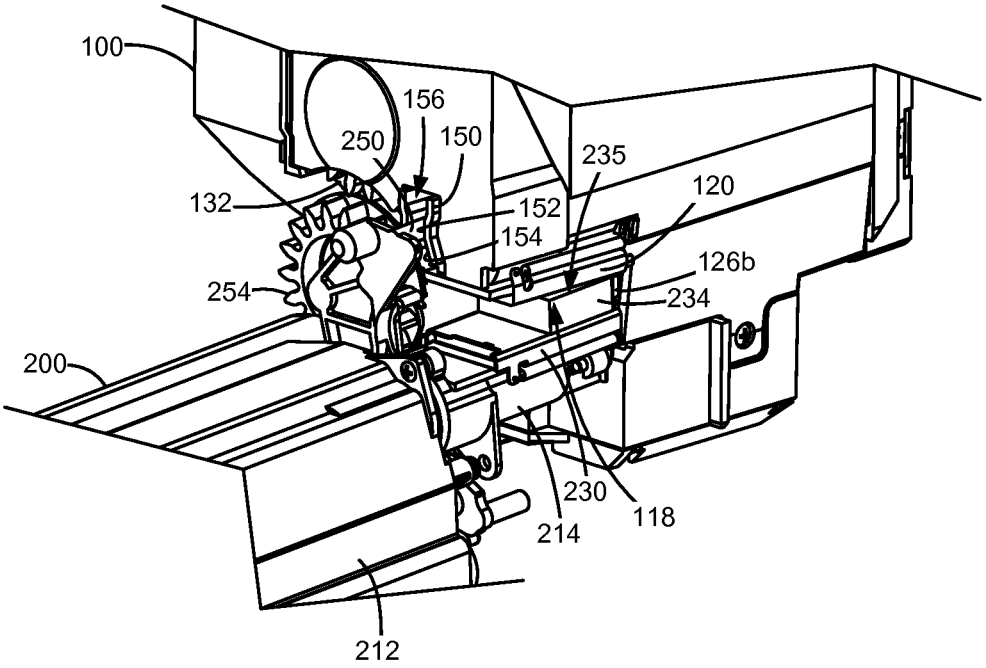
Figure 11B:
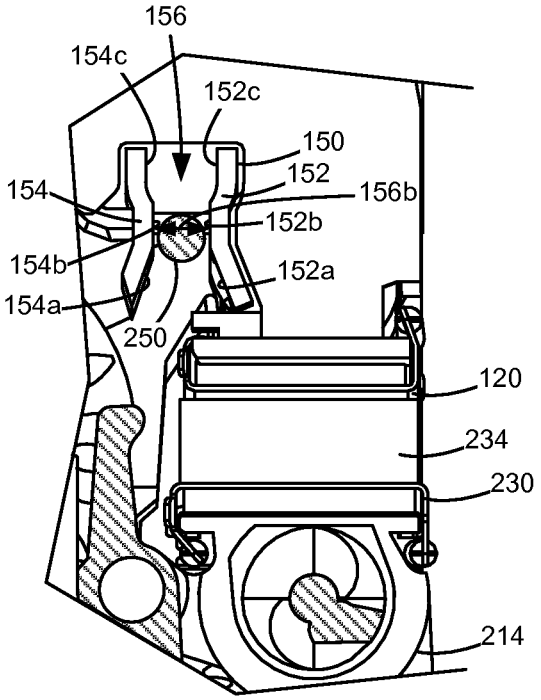

FIGS. 11A and 11B show toner cartridge 100 advanced further toward developer unit 200 with actuation pin 250 positioned in alignment section 156*b* of slot 156 of alignment member 150 between peaks 152*b* and 154*b*. Drive gear 132 is advanced closer to drive gear 254 of developer unit 200. When actuation pin 250 is in alignment section 156*b*, upper seal member 234 comes into contact with shutter 120. The relatively narrow width of alignment section 156*b* between peaks 152*b* and 154*b* controls the position of developer unit 200 relative to toner cartridge 100 to ensure that upper seal member 234 is positioned square to shutter 120 and to ensure that opening 122 of shutter 120 aligns with opening 235 of upper seal member 234 as well as openings 231 and 233 of shutter 230 and lower seal member 232. If, on the other hand, upper seal member 234 was misaligned relative to shutter 120, upper seal member 234 may not seal around opening 122 of shutter 120 causing toner to leak between shutter 120 and upper seal member 234 when toner is transferred from toner cartridge 100 to developer unit 200. Further, if upper seal member 234 was tilted or angled relative to shutter 120 as shutter 120 comes into contact with upper seal member 234 while toner cartridge 100 lowers onto developer unit 200, upper seal member 234 could be compressed between shutter 120 and shutter 230 in a misaligned state bowed to one side or the other. If upper seal member 234 is bowed when toner cartridge 100 is in its final, seated position, upper seal member 234 may restrict the toner flow from toner cartridge 100 to developer unit 200.

Figure 12A:
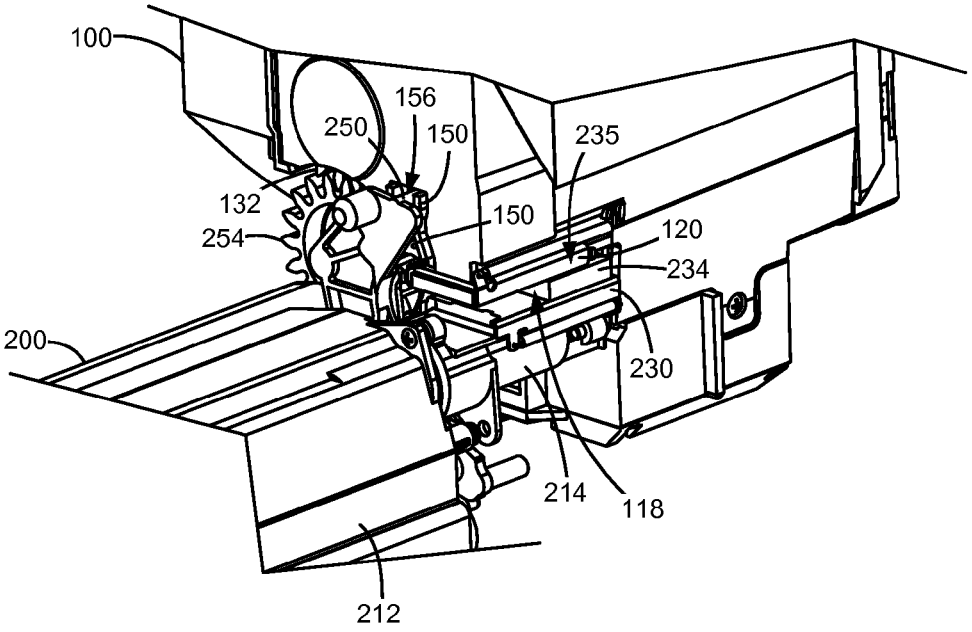
Figure 12B:
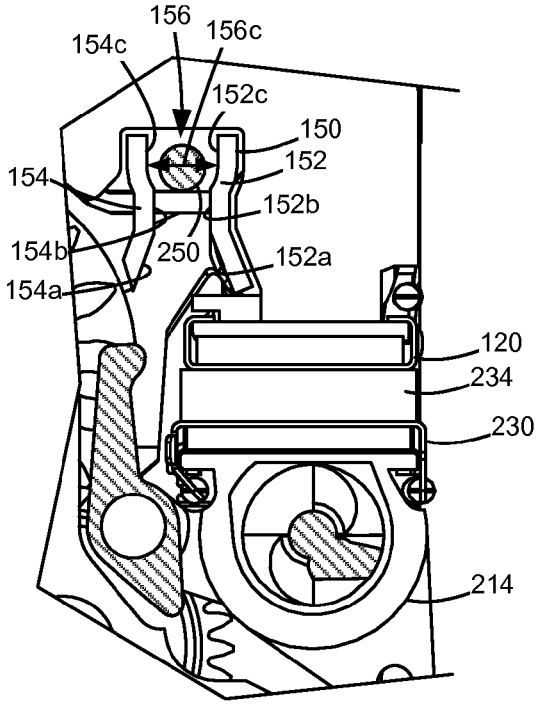

FIGS. 12A and 12B show toner cartridge 100 advanced to its final, seated position mated with developer unit 200 with actuation pin 250 positioned in lead-out section 156*c* of slot 156 of alignment member 150 between second ramped surfaces 152*c* and 154*c*. Drive gear 132 is mated with drive gear 254 to receive rotational power. As actuation pin 250 transitions from alignment section 156*b* to lead-out section 156*c* and travels up lead-out section 156*c*, upper seal member 234 is compressed against shutter 120 maintaining the alignment between opening 122 of shutter 120 and opening 235 of upper seal member 234. As actuation pin 250 advances up lead-out section 156*c*, the increased width of slot 156 between second ramped surfaces 152*c* and 154*c* frees developer unit 200 to move relative to toner cartridge 100. This prevents toner cartridge 100 from imposing an undesired force on developer unit 200 that could disturb the alignment between developer roll 206 and PC drum 302 which could result in non-uniform printing. In its aligned, compressed state, upper seal member 234 is able to flex as needed in order to permit developer unit 200 to move relative to toner cartridge 100 in order to maintain proper alignment between developer roll 206 and PC drum 302. In FIGS. 12A and 12B, shutter 120 of toner cartridge 100 and shutter 230 of developer unit 200 are closed preventing toner from escaping outlet port 118 or inlet port 220.

Figure 13A:
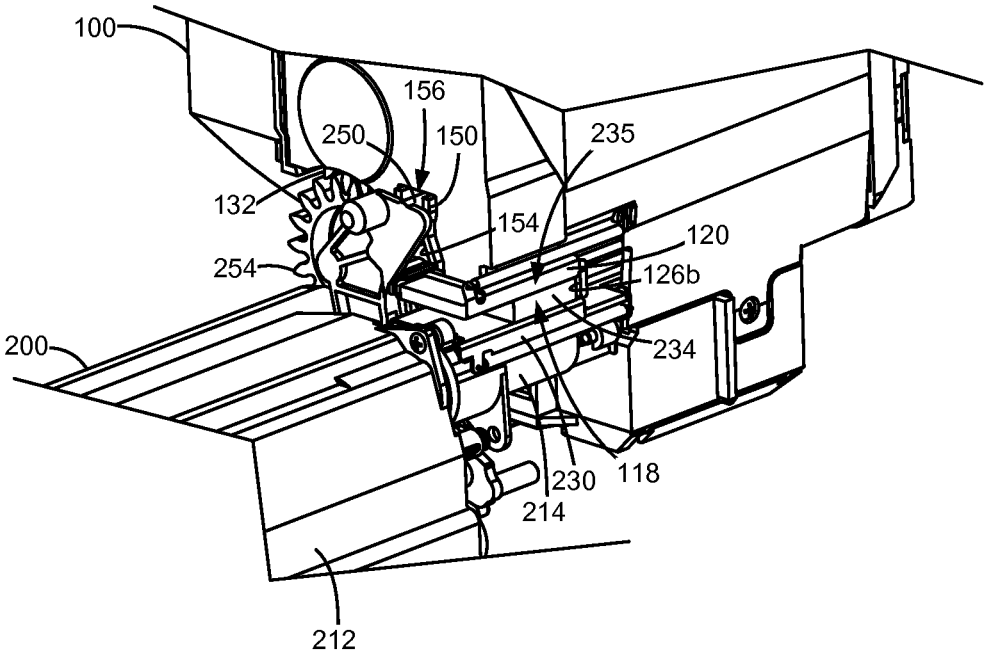
Figure 13B:
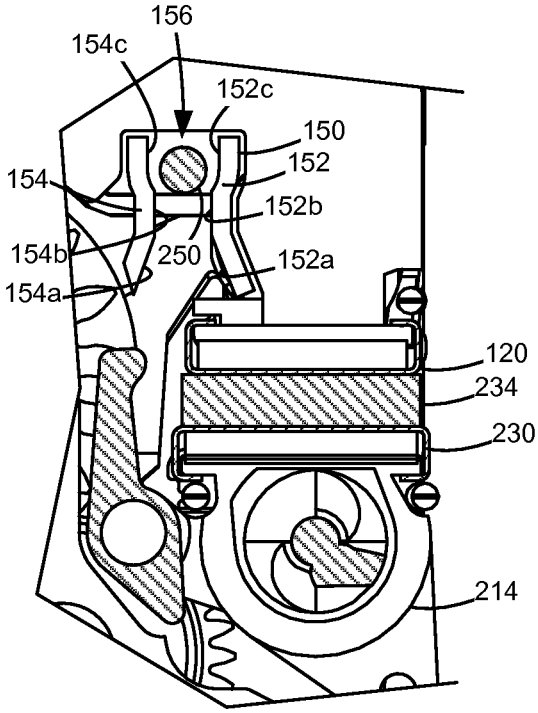

FIGS. 13A and 13B show toner cartridge 100 is its final, seated position with an access door to image forming device 20 closed. When the access door is closed, an actuation member operatively coupled to the access door contacts rear end 126*a* of plunger 126 overcoming the bias applied by spring 130 and causing plunger 126 to advance forward within channel 128. Front end 126*b* of plunger 126 advances past front opening 128*b* of channel 128 into contact with shutter 120 of toner cartridge 100 and shutter 230 of developer unit 200 pushing shutter 120 and shutter 230 from their closed positions to their open positions. With toner cartridge 100 and developer unit 200 mated with each other and shutters 120 and 230 in their open positions, outlet port 118, opening 122 of shutter 120, opening 235 of upper seal member 234, opening 231 of shutter 230 and opening 233 of lower seal member 232 are aligned to permit toner to flow from toner cartridge 100 into developer unit 200.

When toner cartridge 100 is removed, this sequence is reversed. When the access door to image forming device 20 is opened, the actuation member disengages from rear end 126*a* of plunger 126 causing plunger 126 to return to its home position as a result of the bias applied by spring 130. This, in turn, causes shutter 120 of toner cartridge 100 and shutter 230 of developer unit 200 to return to their closed positions prior to toner cartridge 100 being removed so that toner does not leak from outlet port 118 or inlet port 220. As toner cartridge 100 is removed, drive gear 132 separates from drive gear 254 and actuation pin 250 reverses downward through slot 156 of alignment member 150 as upper seal member 234 separates from shutter 120. The width W at the top end of lead-out section 156*c* of slot 156 is large enough for lead-out section 156*c* to capture actuation pin 250 through the entire range of motion in the side-to-side direction of developer unit 200 in frame 306 as toner cartridge 100 is separated from developer unit 200.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use with a developer unit of an image forming device, comprising:

a housing having a front, a rear, a top, a bottom, a first side and a second side, the housing having a reservoir for holding toner;

an outlet port on the front of the housing proximate the first side for transferring toner from the reservoir to the developer unit;

a drive gear on the front of the housing having a center closer to the second side than the outlet port, the drive gear positioned to receive rotational power when the toner cartridge is installed in the image forming device;

an alignment slot on the front of the housing, the alignment slot is positioned between the outlet port and the drive gear in a horizontal direction between the first side and the second side and is positioned above the outlet port in a vertical direction between the top and the bottom, the alignment slot being open at a bottom end of the alignment slot to receive an alignment pin of the developer unit, the alignment slot having a width that narrows from the bottom end of the alignment slot to a middle section of the slot and that widens from the middle section of the alignment slot to a top end of the alignment slot; and a first guide proximate the first side and a second guide proximate the second side, the first and second guides each running along a portion of the front of the housing along the vertical direction between the top and the bottom, the first and second guides being aligned with each other in the vertical direction between the top and the bottom and spaced from each other in the horizontal direction between the first side and the second side forming the alignment slot therebetween, wherein the first guide bows toward the second side and then back toward the first side as the first guide travels up the front of the housing and the second guide bows toward the first side and then back toward the second side as the second guide travels up the front of the housing.

2. The toner cartridge of claim 1, wherein the alignment slot is positioned below the center of the drive gear in the vertical direction between the top and the bottom.

3. A toner cartridge for use with a developer unit of an image forming device, comprising:

a housing having a front, a rear, a top, a bottom, a first side and a second side, the housing having a reservoir for holding toner;

an outlet port on the front of the housing proximate the first side for transferring toner from the reservoir to the developer unit;

a drive gear on the front of the housing having a center closer to the second side than the outlet port, the drive gear positioned to receive rotational power when the toner cartridge is installed in the image forming device; and an alignment member that includes:

a pair of guides running along a portion of the front of the housing along a a vertical direction between the top and the bottom and positioned between the outlet port and the drive gear in a horizontal direction between the first side and the second side and positioned above the outlet port and below the center of the drive gear in the vertical direction between the top and the bottom; and an alignment slot formed between a respective side surface of each guide and having an open bottom end to receive an alignment pin of the developer unit, bottom portions of the side surfaces of the guides forming the alignment slot tapering towards each other as the guides travel up the front of the housing and top portions of the side surfaces of the guides forming the alignment slot tapering away from each other as the guides travel up the front of the housing such that a width of the alignment slot narrows as the alignment slot travels up the front of the housing and then widens as the alignment slot travels further up the front of the housing.

4. The toner cartridge of claim 3, wherein middle portions of the side surfaces between the top portions and the bottom portions of the side surfaces each include a substantially vertical surface.

5. A toner cartridge for use with a developer unit of an image forming device, comprising:

a housing having a front, a rear, a top, a bottom, a first side and a second side, the housing having a reservoir for holding toner;

an outlet port on the front of the housing proximate the first side for transferring toner from the reservoir to the developer unit;

a drive gear on the front of the housing having a center closer to the second side than the outlet port, the drive gear positioned to receive rotational power when the toner cartridge is installed in the image forming device;

an alignment slot on the front of the housing, the alignment slot is positioned between the outlet port and the drive gear in a horizontal direction between the first side and the second side and is positioned above the outlet port in a vertical direction between the top and the bottom, the alignment slot being open at a bottom end of the alignment slot to receive an alignment pin of the developer unit, the alignment slot having a width that narrows from the bottom end of the alignment slot to a middle section of the slot and that widens from the middle section of the alignment slot to a top end of the alignment slot; and a first guide proximate the first side and a second guide proximate the second side, the first and second guides each running along a portion of the front of the housing along the vertical direction between the top and the bottom, the first and second guides being aligned with each other in the vertical direction between the top and the bottom and spaced from each other in the horizontal direction between the first side and the second side forming the alignment slot therebetween, wherein the first and second guides each include a first ramped surface proximate a bottom end of the respective first or second guide, a second ramped surface proximate a top end of the respective first or second guide and a peak positioned between the first ramped surface and the second ramped surface in a middle section of the respective first or second guide; the first ramped surfaces tapering towards each other as the first and second guides travel up the front of the housing and the second ramped surfaces tapering away from each other as the first and second guides travel up the front of the housing.

6. The toner cartridge of claim 5, wherein the peaks of the first and second guides each include a substantially vertical surface.

7. The toner cartridge of claim 5, wherein the alignment slot is positioned below the center of the drive gear in the vertical direction between the top and the bottom.

8. A toner cartridge for use with a developer unit of an image forming device, comprising:

a housing having a front, a rear, a top, a bottom, a first side and a second side, the housing having a reservoir for holding toner;

an outlet port on the front of the housing proximate the first side for transferring toner from the reservoir to the developer unit;

a drive gear on the front of the housing having a center closer to the second side than the outlet port, the drive gear positioned to receive rotational power when the toner cartridge is installed in the image forming device; and an alignment member that includes:

a pair of guides running along a portion of the front of the housing along a vertical direction between the top and the bottom and positioned below the center of the drive gear in a vertical direction between the top and the bottom; and an alignment slot formed between a respective side surface of each guide and having an open bottom end to receive an alignment pin of the developer unit, bottom portions of the side surfaces of the guides forming the alignment slot tapering towards each other as the guides travel up the front of the housing and top portions of the side surfaces of the guides forming the alignment slot tapering away from each other as the guides travel up the front of the housing such that a width of the alignment slot narrows as the alignment slot travels up the front of the housing and then widens as the alignment slot travels further up the front of the housing.

9. The toner cartridge of claim 8, wherein middle portions of the side surfaces between the top portions and the bottom portions of the side surfaces each include a substantially vertical surface.

* * * * *